US009380656B2

(12) United States Patent
Radermacher

(10) Patent No.: US 9,380,656 B2
(45) Date of Patent: Jun. 28, 2016

(54) POWER CONTROL UNIT AND METHOD FOR CONTROLLING ELECTRICAL POWER PROVIDED TO A LOAD, IN PARTICULAR AN LED UNIT, AND VOLTAGE CONTROL UNIT FOR CONTROLLING AN OUTPUT VOLTAGE OF A CONVERTER UNIT

(75) Inventor: Harald Josef Günther Radermacher, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 64 days.

(21) Appl. No.: 14/241,198

(22) PCT Filed: Sep. 5, 2012

(86) PCT No.: PCT/IB2012/054576

§ 371 (c)(1),
(2), (4) Date: Feb. 26, 2014

(87) PCT Pub. No.: WO2013/035045

PCT Pub. Date: Mar. 14, 2013

(65) Prior Publication Data

US 2014/0197760 A1 Jul. 17, 2014

Related U.S. Application Data

(60) Provisional application No. 61/531,267, filed on Sep. 6, 2011.

(51) Int. Cl.
*H05B 37/02* (2006.01)
*H05B 33/08* (2006.01)

(52) U.S. Cl.
CPC ..... *H05B 33/0815* (2013.01); *H05B 33/0842* (2013.01)

(58) Field of Classification Search
CPC .... H05B 37/02; H05B 33/08; H05B 33/0815; H05B 33/0842; H05B 33/0845
USPC ..... 315/194, 195, 291, 224, 307, 308, 315/DIG. 4
See application file for complete search history.

(56) References Cited

U.S. PATENT DOCUMENTS 8,987,995 B2 * 3/2015 Moussakov ..... H05B 33/0815 315/193
2008/0258647 A1 10/2008 Scianna
2010/0327776 A1 * 12/2010 Yufuku et al. ..... 315/307

FOREIGN PATENT DOCUMENTS

WO 2009121956 A1 10/2009
WO 2010137002 A1 12/2010

(Continued)

*Primary Examiner* — Jimmy Vu

(57) ABSTRACT

The present invention relates to a power control unit (40; 60) for controlling electrical power provided to a load (12), in particular an LED unit (12) comprising one or more LEDs, said driver device comprising a converter unit (10) having an input terminal (42) for receiving an input voltage (V10) from an external power supply (22) and having an output terminal (44) for providing an output voltage (V14) to power the load (12), wherein the converter unit (10) comprises a switching device (14) for transforming the input voltage (V10) to the output voltage (V14), a control unit (20) for controlling the switching device (14), signal means (46; 62) connected to the output terminal (44) for applying a voltage or current signal to the output terminal (44), wherein the control unit (20) is connected to the signal means (46; 62) and adapted to control the signal means (46; 62).

14 Claims, 5 Drawing Sheets

(56) References Cited

FOREIGN PATENT DOCUMENTS

| | | | |
|---|---|---|---|
| WO | 2010150183 | A1 | 12/2010 |
| WO | 2011001327 | A1 | 1/2011 |
| WO | 2011013060 | A2 | 2/2011 |
| WO | 2011045371 | A1 | 4/2011 |

* cited by examiner

POWER CONTROL UNIT AND METHOD FOR CONTROLLING ELECTRICAL POWER PROVIDED TO A LOAD, IN PARTICULAR AN LED UNIT, AND VOLTAGE CONTROL UNIT FOR CONTROLLING AN OUTPUT VOLTAGE OF A CONVERTER UNIT

FIELD OF THE INVENTION

The present invention relates to a power control unit and a corresponding method for controlling electrical power provided to a load, in particular an LED unit comprising one or more LEDs. Further, the present invention relates to a voltage control unit for controlling an output voltage of a converter unit. Further, the present invention relates to a light apparatus.

BACKGROUND OF THE INVENTION

In the field of LED drivers for offline applications such as retrofit lamps and new lamps or modules solutions are demanded to cope with high efficiency, high power density and high power factor among other relevant features. While practically all existing solutions comprise one or the other requirement, it is essential that the proposed driver circuit properly condition the form of the mains energy into the form required by the LEDs while keeping compliance with present and future power mains regulations. Of critical importance is to control the amount of power delivered to the lamps to control the brightness of the lamps while having a high efficiency and reduced power loss in the power converter. To control the amount of power delivered to the lamps a phase cut dimming is one option having a high efficiency and low power loss. If driver devices are used including a phase cut dimmer, the lamps derive the electrical power from the phase cut mains voltage and have to recover the phase cut position, in order to set the power level accordingly. Trailing edge phase cut dimmers, which are preferably used, do not always provide a voltage step with a significant edge, which is easy to detect due to the filter capacitors across the lamp and across the dimmer. Hence, the lamps are provided with a bleeder circuit to drain the charged capacitor, in order to verify that the dimmer is turned off. This is a technically complicated solution to detect the edge of the phase cut signal and increases the power loss in the lamps.

WO 2011/045371 A1 discloses a phase cut dimming device for LED units for providing a phase cut driving voltage to drive the LEDs. The phase cut dimmer is connected to a control unit to drive the dimmer and to cut the mains voltage at predefined positions.

WO 2010/137002 A1 discloses a phase cut driver device for driving an LED unit, wherein the LED unit comprises a bleeder circuit to adjust the rectified phase cut input voltage. The bleeder circuits comprise detection means to detect the voltage drop at two predefined voltage levels to activate two bleeder circuits. A detection of the phase angle of the phase cut voltage is not precisely possible with this bleeder circuit.

SUMMARY OF THE INVENTION

It is an object of the present invention to provide a power control unit and a corresponding method for controlling electrical power provided to a load, in particular an LED unit comprising one or more LEDs, providing a high power factor, reduced losses, high efficiency and low cost. Further, it is an object of the present invention to provide a corresponding light apparatus. It is a further object of the present invention to provide a voltage controller for controlling an output voltage of a converter unit which provides a high efficiency, reduced power loss with low technical effort.

According to an aspect of the present invention a driver device for driving a load, in particular an LED unit comprising one or more LEDs, is provided comprising:

- a converter unit having an input terminal for receiving an input voltage from an external power supply and an output terminal for providing an output voltage to power the load, wherein the converter unit comprises a switching device for transforming the input voltage to the output voltage,
- a control unit for controlling the switching device,
- signal means connected to the output terminal applying a voltage or current signal to the output terminal, wherein the control unit is connected to the signal means and adapted to control the signal means.

According to another aspect of the present invention a voltage controller for controlling an output voltage of a converter unit is provided, comprising:

- a first connection terminal for connecting the voltage controller to an output of the driver device,
- a second connection terminal for connecting the voltage controller to neutral or an input terminal or the driver device,
- signal means for applying a voltage or a current signal to the first connection terminal,
- detection means for detecting a phase cut-off of the output voltage wherein the detection means are adapted to control the signal means dependent on the detected phase cut-off.

According to another aspect of the present invention a corresponding method for controlling electrical power provided to a load is provided.

According to still another aspect of the present invention a light apparatus is provided comprising a light assembly comprising one or more light units, in particular an LED unit comprising one or more LEDs, and a driver device for driving the light assembly as provided according to the present invention.

Preferred embodiments of the invention are defined in the dependent claims. It shall be understood that the claimed method has similar and/or identical preferred embodiments as the claimed device and as defined in the dependent claims.

The present invention is based on the idea to provide a power control unit for dimming a voltage of an external voltage supply such as mains e.g. by means of phase cut dimming and wherein the voltage supplied to the load comprises a significant and easy to detect turn off signal. This is achieved by means of signal means connected to the output of the power control unit or a converter unit of the power control unit to apply a voltage or a current signal in order to set the voltage at the output terminal accordingly. By means of such signal means, a significant voltage step can be provided at the output voltage of the power control unit or the converter unit. Since the same control unit which controls the switching device of the converter unit is connected to the signal means, signal means can be synchronized to the converter unit to deliver a significant and easy to detect turn off signal dependent on the phase angle of the voltage provided by the converter unit. Hence, the output voltage can be changed rapidly in order to deliver a significant and easy to detect turn off signal to the load with low technical effort. As a benefit, the total losses in the system due to bleeding are reduced, because the current control unit is only activated when required and the loads do not need to bleed their input voltage for extended periods of time or with high power, or even no bleeding is required by the loads at all.

A second aspect of the present invention is based upon the idea to provide a separate voltage control unit for controlling the output voltage of an existing converter unit in particular an existing dimmer connected to a load, in particular an LED unit which is adapted to change the voltage supplied to the load rapidly in order to deliver a significant and easy to detect turn off signal to the load. Since the control signal controlling the converter unit is not available for such a separate voltage controller, the phase angle of the output voltage is detected by means of the detection means wherein detection means control or activate the signal means accordingly to provide an output voltage having a significant and easy to detect turn off signal. Hence, the voltage controller according to this aspect of the present invention can be connected to an existing converter unit as a separate add-on module for retrofitting to a power control unit or a driver device.

Preferably, the control unit and the signal means are synchronized to each other that a deterministic relationship is provided between the activation period of the switching device and the application for the signal to the output terminal.

In an embodiment the input voltage is an AC voltage preferably provided by mains and the converter unit is a phase cutting device, wherein the switching device is provided for cutting the phase of the AC voltage. This embodiment is simple to implement and provides a dimmer with low power loss.

In an embodiment the signal means comprise a current control unit for providing the signal by controlling a current drawn from the output terminal or provided to the output terminal. This is a simple solution to adapt the output voltage with reduced power loss.

In a particularly advantageous embodiment, the power control unit comprises detection means for detecting the output voltage. Hence, the output voltage can be detected and the signal means can be controlled accordingly to provide a desired output voltage. This allows to adapt the output voltage to the required level, avoiding extra losses.

According to a preferred embodiment, the signal means is adapted for controlling the course of the output voltage and for setting the slope of the output voltage to a predefined level. Thus, a predefined and/or desired course of the output voltage and a predefined slope of the output voltage can be achieved which is easy to detect by the load. Again, this allows to avoiding extra losses.

According to a preferred embodiment, the control unit is adapted for activating the signal means when the output voltage is cut off by means of the switching device. Thus, the voltage or current signal applied by the signal means provide a significant change of the output voltage when the phase is cut off such that the phase angle can be precisely detected by the dimmable load.

In a further embodiment, the current control unit comprises a current source, which is activated by the control unit. Hence, a predefined current can be provided which is independent of the voltage drop across the load such that a predefined change of the output voltage can be provided.

In another embodiment, the signal means comprise a controllable switch, which is activated by means of the control unit. A controllable switch provides a simple solution for signal means to provide the required current and to provide the desired change of the output voltage.

According to a preferred embodiment, the signal means are connected to a neutral potential of the external power supply. Hence, a simple solution is provided to provide the voltage dip of the output voltage since the current control unit is connected to a predefined voltage potential which is lower than the output voltage.

According to another embodiment, the signal means comprise a controllable switch connected to a charge capacitor which is connected to an input terminal of the power conversion unit, wherein a diode is connected in parallel to the controllable switch for charging the capacitor, and wherein the controllable switch is controlled by means of the control unit. Thus, a two-wire dimmer (where no connection to neutral is possible) can be provided, since the current control unit is connected between the output and the input terminal of the converter unit.

In a further embodiment, the signal means comprise in parallel to the power conversion unit two charge capacitors each connected in series with one diode, wherein the diodes are arranged in opposite forward-bias directions for charging the capacitors with different polarity, wherein one controllable switch is connected in parallel to each of the diodes and controlled by the control unit. Hence, a two-wire dimmer can be provided with a current control unit or a dip generator for an alternating input voltage, since a positive and negative voltage is available at any state or point in time, since the two capacitors are charged with different polarities by means of the diodes arranged in opposite directions.

In this embodiment, it is preferred that the control unit is adapted to activate one of the two controllable switches when the output voltage is cut off by means of the switching unit dependent on the polarity of the input or output voltage. Thus, a significant change of the output voltage can be provided with low technical effort independent of the polarity of the input and/or output voltage since the two switches are provided to connect the output terminal to one of the differently charged capacitors.

According to a preferred embodiment of the voltage controller, the signal means comprises a current source or a controllable switch for controlling an electrical current drawn from the first connection terminal or provided to the first connection terminal. This provides a simple solution with low technical effort to provide a retrofit voltage controller.

According to an alternative embodiment of the voltage controller, the signal means comprises two charge capacitors each connected in series with one diode, wherein the diodes are arranged in opposite forward-bias directions for charging the capacitors with different polarity and wherein the diodes are each connected in parallel to one controllable switch controlled by the detection means. Hence, a voltage controller can be provided as an add-on module connectable to a two-wire driver device, since the voltage controller only needs to be connected to the input and the output terminal of the driver device and wherein a defined voltage potential is provided to achieve the desired step of the output voltage.

Hence, various embodiments exist for controlling the output voltage of a power control unit or a converter unit of a power control unit and to change the output voltage rapidly to deliver a significant and easy to detect turn of signals to the connected load.

As mentioned above, by the signal means, a signal can be applied to the output of the converter unit. In particular, a desired course of the output voltage can be provided and a predefined slope can be set by means of the current control unit. Preferably, the signal means are connected between the output terminal of the converter unit and neutral of the external power supply. According to an alternative embodiment, the signal means are connected between the input and the output terminal to provide a two-wire power control unit.

Hence, a desired change of the output voltage can be realized with low technical effort to deliver the turn of signal to the lamps.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1A:
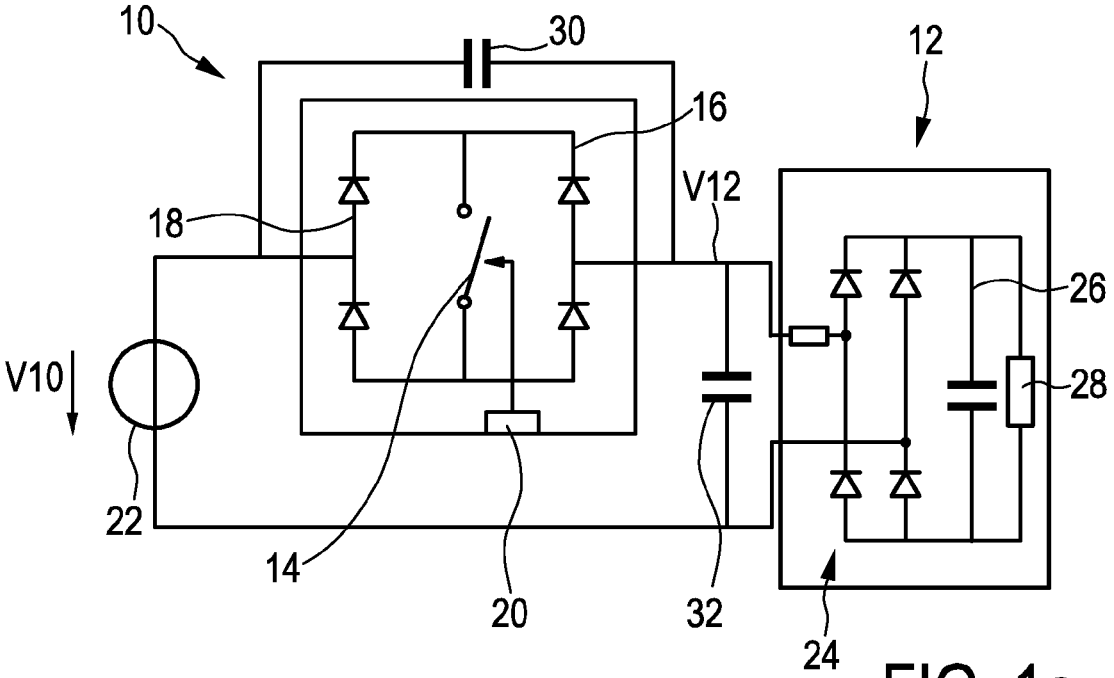
FIG. 1*a* shows a schematic block diagram of a known dimmer driver device for an LED unit.

An embodiment of a known dimmer driver device 10 for driving an LED unit 12 is schematically shown in FIG. 1*a*. Said dimmer 10 comprises a switch 14 coupled in a diode bridge rectifier 16, 18 and a control unit 20 for controlling the switch 14. The dimmer 10 is connected to an external voltage supply 22, e.g. an external mains voltage supply 22 and adapted for providing a phase cut AC output voltage V12 from the AC input voltage V10. The dimmer 10 converts the AC input voltage V10 into the phase cut output voltage V12 by switching the switch 14 and disconnecting the connection between the external voltage supply 22 and an output terminal of the dimmer 10. The control unit 20 controls the switch 14 either to provide a leading edge or a trailing edge phase cut signal. The LED unit 12 is connected to the dimmer 10 and a neutral line of the external voltage supply 22. The LED unit comprises a rectifier 24 for rectifying the AC phase cut signal and a charge capacitor 26 and a load 28 such as an LED 28. However, different types of power stages in the LED unit 12 are possible, e.g. including a switch mode power supply, power factor correction means, bleeders, controllers for adapting the amount of energy delivered to the LED, measurement means to detect the phase angle, ect.

A charge capacitor 30 (e.g. 10 nF) is connected in parallel to the dimmer 10. A charge capacitor 32 is connected in parallel to the LED unit 12.

The dimmer 10 can provide phase cut dimming with leading edge (Triac dimmer, Type R, RL), however, the steep rising edge of the voltage applied to the load may cause distortion and inrush currents. Alternatively the dimmer 10 can provide trailing edge phase cut dimming (MOSFET dimmer, Type R, RC) to avoid the steep rise of the voltage applied to the load. In this case, the connection to the output voltage V12 to the input voltage V10 is established by closing switch 14 at (or close to) each zero crossing of the supply voltage V10 and is cut off at a desired phase angle by opening the switch 14. However, it is complicated for the load to detect the turn off point in this signal, since this signal does not always have a steep voltage edge due to the filter capacitors 30, 32 across the LED unit 12 and the dimmer 10. Some lamps try to load their input terminals with an extra load (bleeder) i.e. during the second half of the half sine (when the absolute value of the voltage is decreasing) to be able to determine the turn off point. This bleeding cause extra losses, and extra effort in the lamps.

Figure 1B:
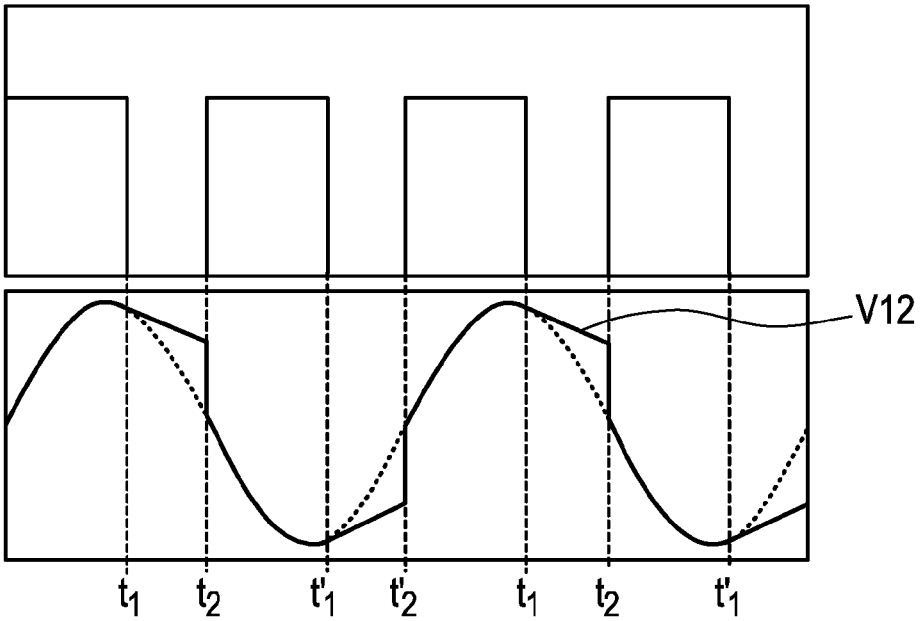
FIG. 1*b* shows a dimmer phase angle signal and the corresponding dimmer supply and output voltage of a known dimmer driver device.

In FIG. 1*b* a diagram is shown illustrating the voltage waveform of the phase cut voltage V12 provided by the dimmer 10 and the corresponding dimmer phase angle signal. In the lower part of FIG. 1*b* the sinusoidal voltage V10 (dashed line) provided by the external voltage supply 22 is shown together with the voltage V12 provided by the dimmer 10 and supplied to the LED unit 12. In the upper part of FIG. 1*b* the dimmer phase angle signal is shown having a square wave signal form. This signal should be recovered by the LED unit. The phase angle signal comprises falling edges at t1 and rising edges at t2. Accordingly, the switch 14 is switched off at t1 and switched on at t2. The output voltage V12 supplied to the LED unit 12 does not show a falling edge at t1, but shows a falling edge at t2, since the switch 14 is switched on at t2 and the output voltage V12 is therefore at t2 identical with the sinusoidal supply voltage V10. Due to the capacitors 30, 32, the output voltage V12 supplied to the LED unit 12 does not show a falling edge at t1, since the charge stored in the capacitors 30, 32 hinders that the output voltage changes abruptly. The second half wave is identical having an opposite polarity. Hence, the phase of the output voltage V12 cannot be detected by the LED unit 12.

It is necessary to provide a significant falling edge in the output voltage signal V12 which can be detected by the LED unit 12 in order to recover the phase angle signal.

Figure 2A:
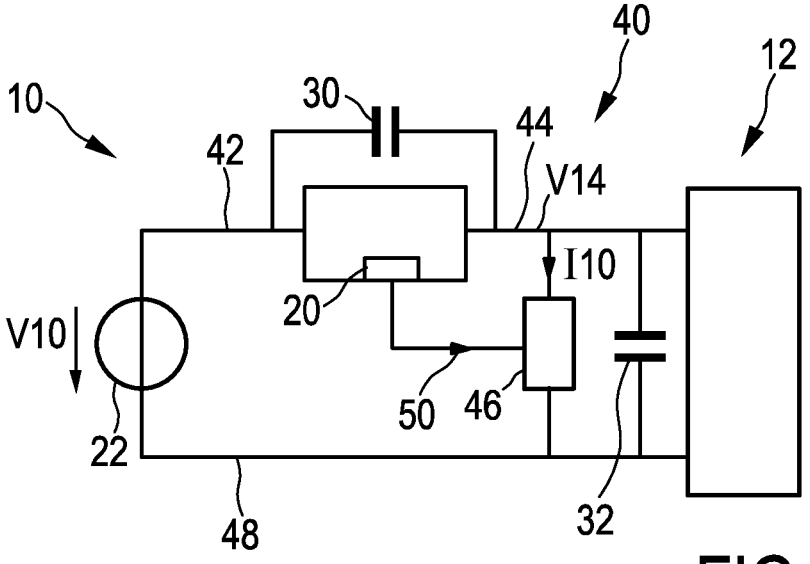
FIG. 2*a* shows a schematic block diagram of a first embodiment of a power control unit according to the present invention.

A first embodiment of a power control unit 40 according to the present invention is schematically shown in FIG. 2*a*. The power control unit 40 comprises the dimmer 10 including the control unit 20 for converting the input voltage V10 provided to an input terminal 42 to an output voltage V14 at an output terminal 44. The dimmer 10 is preferably identical with the dimmer 10 of FIG. 1*a*. The LED unit 12 is preferably identical with the LED unit 12 of FIG. 1*a* and represents generally a load of the driver device 40. The capacitor 32 (e.g. 100 nF) is connected in parallel to the LED unit 12. In parallel to the LED unit a current control unit 46 is connected to the output terminal 44 and to a neutral line 48 or a neutral potential 48 of the input voltage supply 22. The current control unit 46 is connected to the control unit 20. The control unit 20 provides a control signal 50 to the current control unit 46. The current control unit 46 is provided for applying a signal to the output terminal 44.

The current control unit 46 forms signal means 46 and is provided for controlling a current I10 drawn from the output terminal 44 to the neutral line 48 of the voltage supply 22.

The current I10 from the output terminal 44 to neutral 48 (or in the opposite direction) can change the output voltage V14 by draining the charge to the neutral potential 48 or providing charge to the output terminal 44. According to the present embodiment of the invention, the control unit 20 switches the switch 14 of the dimmer 10 off and activates the current control unit 46 by means of the control signal 50. The current control unit 46 is provided as a controllable current source or a controllable switch to provide the current I10. The dimmer 10 can be provided with detection means for detecting the output voltage V14 so that the control unit 20 can adjust the current I10 by means of the current control unit to set a predefined voltage drop or a predefined slope of the output voltage V14. In a certain embodiment, the control unit 20 applies by means of the current control unit 46 a predefined default current I10, the detection means detects the decay of the output voltage V14 and the control unit 20 adjusts the current setting of the current I10 by means of the current control unit until 46 a desired slope or course of the output voltage V14 is achieved. This may take a few cycles until the desired decay is achieved. In another embodiment, a slope of the output voltage V14 is predefined and the bleeding current is adjusted so that the output voltage V14 follows that predefined slope.

Figure 2B:
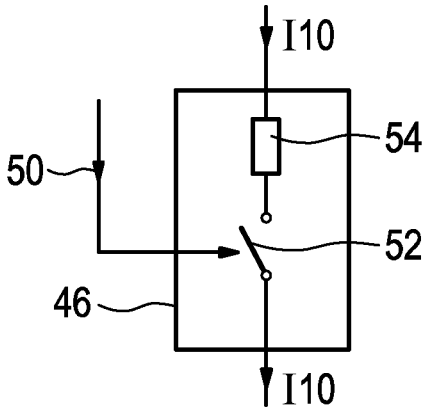
FIG. 2*b* shows a detailed block diagram of a current control unit according to the first embodiment.

FIG. 2*b* schematically illustrates the current control unit 46 according to one embodiment of the driver device 40. The current control unit 46 comprises a controllable switch 52 and a resistor 54 connected in series with each other. The controllable switch 52 is controlled by the control unit 20 by means of a control signal 50. In this embodiment, the control unit 20 switches the controllable switch 52 on at the same time (corresponding to t1) when the switch 14 of the dimmer 10 is switched off. Hence, the current I10 is provided from the output terminal 44 to the neutral line 48 at the time when the phase of the supply voltage V10 is cut off so that a significant change of the output voltage V14 is achieved. Thus, the phase cut or the turn off can be detected by the LED unit 12 with low technical effort. In other words, the current control means form signal means for applying signals to the output terminal 44 when the phase of the input voltage is cut off.

The current control unit 46 partially shunts the output of the dimmer 10 to the neutral line 48. Hence, the supply voltage for the LED unit 12 changes rapidly and creates a significant, easy to detect signal drop or falling or rising edge. The amount of the current I10 depends on the number of LED units 12 connected to the dimmer 10, since each lamp increases the absolute capacitive loading of the dimmer 10. The active control or the current setting by means of the current source in the current control unit 46 can be used to achieve a predefined voltage step or falling/rising edge as mentioned above preferably for a variable number of connected lamps or LED units 12.

According to an alternative embodiment, the controllable switch 52 is formed of a controllable current source to set the current I10 to a predefined value. E.g. semiconductor switches with some linear (resistive) region or with current limiting region can be used and controlled (using an appropriate base or gate signal) to result in a suitable resistance.

Therefore, a three-wire dimmer comprising the input terminal 42 (phase in), the output terminal 44 (phase out) and the neutral line 48 is provided.

Figure 3A:
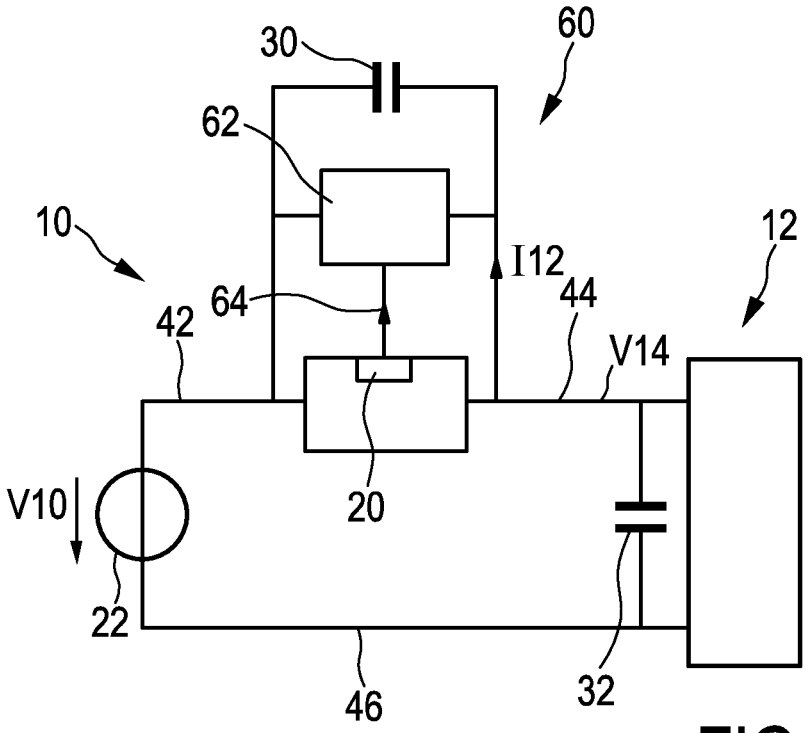
FIG. 3*a* shows a schematic block diagram of a second embodiment of a power control unit according to the present invention.

FIG. 3*a* schematically illustrates a further embodiment of a power control unit 60 of the present invention. The power control unit 60 comprises the dimmer 10 connected to the external voltage supply 22 for driving the LED unit 12 as shown in FIG. 1*a* or 2*a*. Identical elements are denoted by identical reference numerals, wherein here only the differences are explained in detail. A current control unit 62 is connected in parallel to the dimmer 10 and forms signal means 62 for applying a signal to the output terminal 44. The current control unit 62 is connected to the input terminal 42 and to the output terminal 44. The current control unit 62 is connected to the control unit 20 of the dimmer 10. The control unit 20 controls the current control unit 62 by means of a control signal 64. The charge capacitor 30 is connected in parallel to the current control unit 62. The current control unit 62 is activated by the control unit 20 when the switch 14 is switched off and the phase of the supply voltage V10 is cut off. Thus, the current control unit 20 provides a current I12 draining the charge from the output terminal 44 or providing charge to the output terminal 44 to provide a predefined voltage step of the output voltage V14, which can be detected by the LED unit 12.

Hence, the driver device 60 is a two-wire driver device or a two-wire dimmer 10 having the input terminal 42 (phase in) and the output terminal 44 (phase out), wherein no wire to the neutral line is provided.

Preferably, the current control unit 62 comprises at least one charge capacitor and a controllable switch or a controllable current source, wherein the charge capacitor is charged and provides a defined potential to drain or to drive the current I12 when the controllable switch or the current source is switched on or activated. Hence, the current control unit 62 provides an active control that can be used to achieve a predefined voltage step or falling/rising edge in the output voltage V14, which is detectable by the LED unit 12.

Figure 3B:
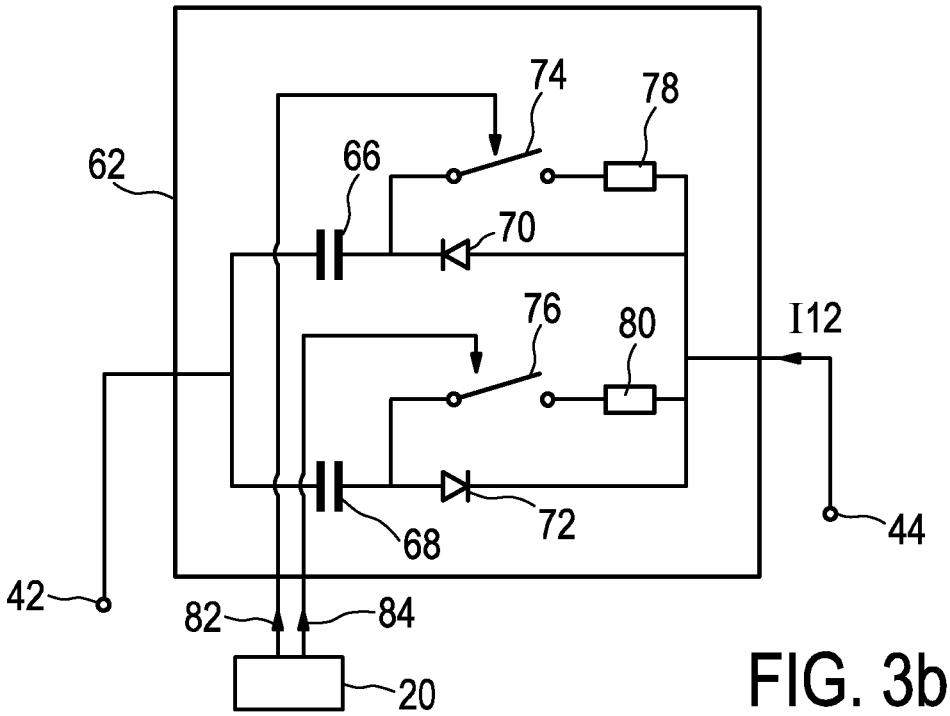
FIG. 3*b* shows a detailed schematic block diagram of a current control unit of the second embodiment.

FIG. 3*b* shows a preferred embodiment of the current control unit 62 of FIG. 3*a*. Identical elements are denoted by identical reference numerals, wherein just the differences are explained in detail.

The current control unit 62 comprises two charge capacitors 66, 68 (e.g. each having 100 nF) each connected in series with a diode 70, 72. The diodes 70, 72 are arranged in opposite forward-bias directions. One controllable switch 74, 76 is connected in parallel to each of the diodes 70, 72. In other words a first switch 74 is connected in parallel to a first diode 70 and a second switch 76 is connected in parallel to a second diode 72. A resistor 78, 80 (e.g. each having 100 Ohm) is connected in series with each of the controllable switches 74, 76. The controllable switches 74, 76 are connected to the control unit 20 and controlled by means of control signals 82, 84.

The charge capacitors 66, 68 are charged via the diodes 70, 72 in opposite polarity due to the opposite forward-bias direction of the diodes 70, 72. Hence, at any time a negative and a positive polarity or electrical potential is available in the current control unit 62. The charge capacitors 66, 68 are charged when the switches 74, 76 are switched off. When the switches 74, 76 are switched on, the respective charge capacitor 66, 68 is discharged via the respective resistor 78, 80. Hence, if one of the switches 74, 76 is switched on, the respective charge capacitor 66, 68 provides a discharge current, which forms the current I12. The current control unit 62 switches or activates one of the controllable switches 74, 76 when the controllable switch 14 of the dimmer 10 is switched off dependent on the polarity of the supply voltage V10. Hence, the current I12 can be provided in different directions for each of the half waves of the supply voltage V10 without having access to the neutral line 48 of the voltage supply 22. In other words, one of the controllable switches 74, 76 is activated when the supply voltage V10 is cut off by means of the dimmer 10 depending on the polarity of the supply voltage V10 or depending on the polarity of the respective half wave of the supply voltage V10. Therefore, the direction of the current I12 depends on the polarity of the supply voltage V10. Hence, a significant step or falling or rising edge in the output voltage V14 can be provided by the driver device 60. In other word, a signal is applied to the output terminal 44 when the phase of the input voltage is cut off.

Figure 4:
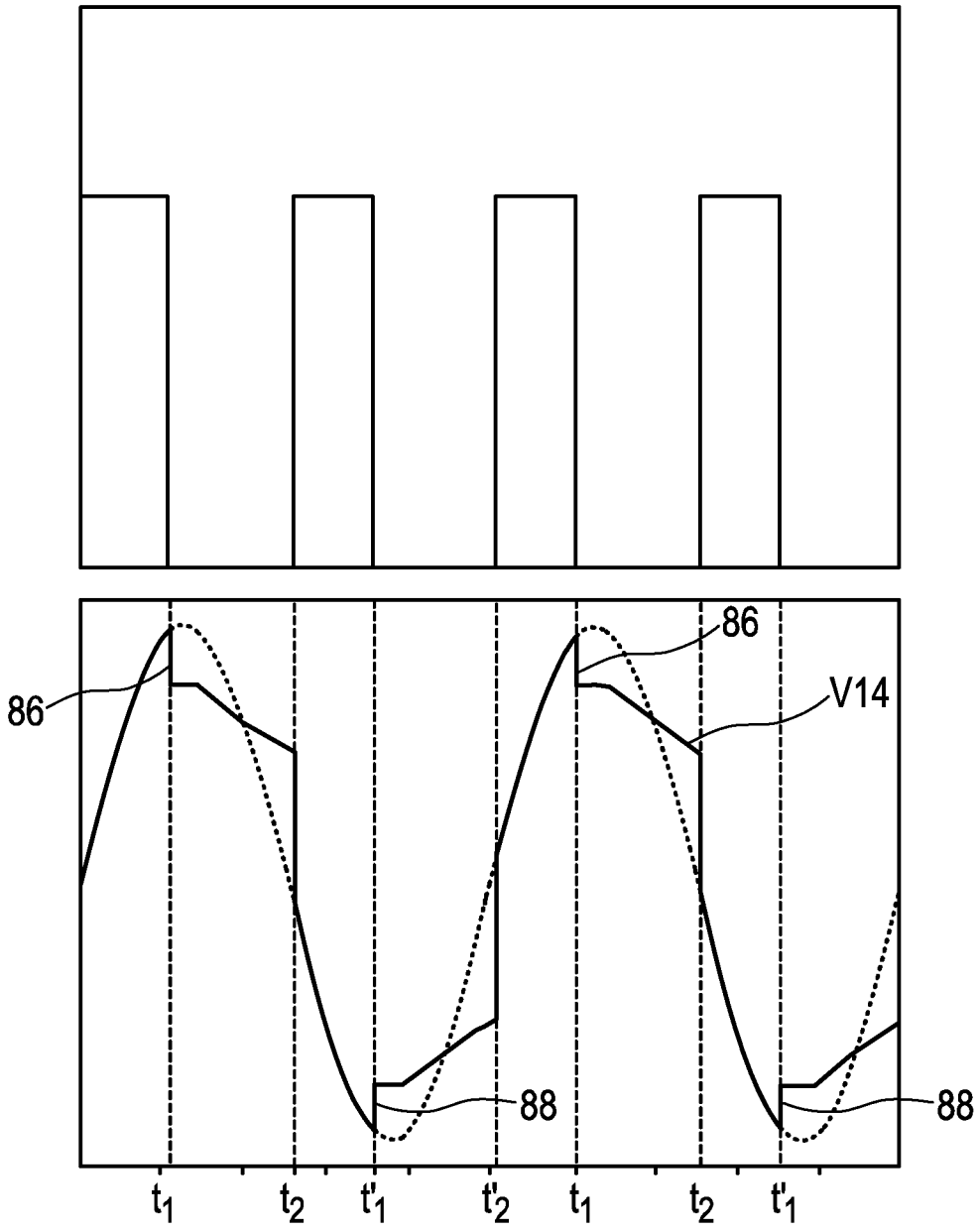
FIG. 4 shows a diagram illustrating the supply and output voltage waveform of the embodiments of the driver device shown in FIGS. 2 and 3 and the corresponding dimmer phase angle signal.

FIG. 4 shows a diagram illustrating the output voltage V14 of the driver devices 40, 60 and the dimmer phase angle signal. In the lower diagram of FIG. 4, the sinusoidal supply voltage V10 (dashed line) and the output voltage V14 are illustrated in superposed manner. In the upper part, the dimmer phase angle signal is shown having a square wave signal form. The dimmer phase angle signal comprises steep edges, wherein a falling edge is shown at t1 and a rising edge is shown at t2 corresponding to FIG. 1*b*.

The output voltage V14 shows at t1 a defined voltage step or a falling edge 86 at t1, which is provided by the current control unit 46, 62. The output voltage V14 comprises a portion having a flat slope until t2 when the switch 14 is switched on and the output voltage V14 is rapidly reduced to zero. The second half wave shows an identical course having an opposite polarity. The second half wave shows at t1' a rising edge 88 identical with the falling edge 86 of the first half wave at t1, the output voltage V14 shows a second rising edge at t2' when the switch 14 is switched on and the output voltage V14 is identical with the supply voltage V10. Hence, the shunt current I10, I12 provides a rising edge 86 or a falling edge 88 in the output voltage V14 which can be detected easily by a LED unit 12. Due to the charge capacitors 30, 32, the voltage V14 shows a flat slope between t1 and t2.

The drain current I10, I12 may cause thermal stress to the switching devices 52, 74, 76. A part of this thermal energy can be shifted to the respective resistors 54, 78, 80. In an alternative embodiment, the resistors 54, 78, 80 may be replaced by a short circuit. In the case that more LED units have to be connected to the driving device 40, 60, the resistor 54 is replaced by an external resistor. Optionally, multiple resistors/components may be present in the dimmer 10, so that not all resistances are short circuit when no external component is installed.

The resistors 78, 80 are not only provided to reduce the thermal stress of the switches 74, 76 but also to scale the edge or the step according to the respective output load or LED unit 12. Also a storage element can be provided as external extension.

To reduce the thermal stress for the dimmer 10, the whole driver device can be based on storing and moving energy from one storing element to the other. For example, since the output loading is a capacitive loading when the switch 14 is switched off an additional switch, an inductor and energy storage can be used to transfer the electrical energy from one element (e.g. the capacitors in the lamps) to another element (e.g. the energy storage capacitor in the current control unit 62). At a suitable point in time, this energy can be released to the circuit, or the lossless current control unit 62.

In a further embodiment, an inductor is connected in series with the output terminal 44 to induce a current required for a fast change of the output voltage V14.

According to a further aspect of the present invention, a voltage control unit comparable with current control units 46, 62 can be provided as separate module. Two voltage controller modules are schematically shown in FIGS. 5*a* and 5*b*.

Figure 5A:
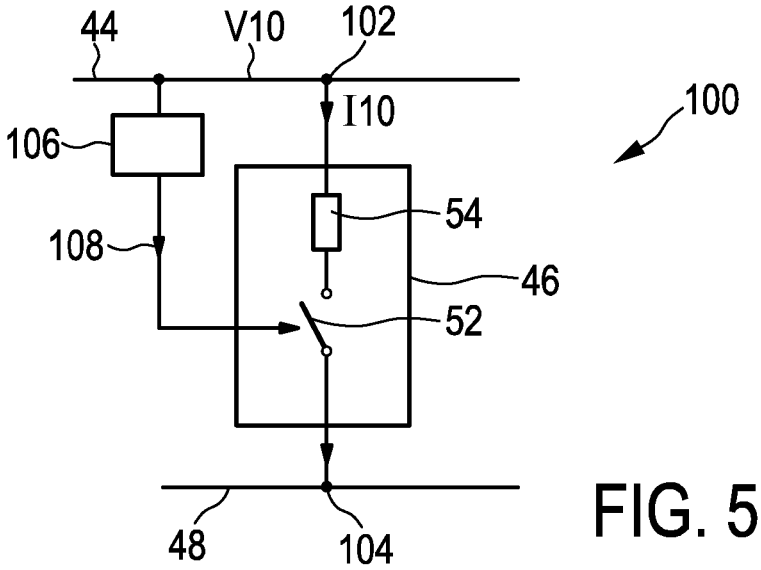
FIG. 5*a* shows a schematic block diagram of a voltage control unit according to a second aspect of the present invention.

A first embodiment of a voltage control unit 100 according to the present invention is schematically shown in FIG. 5*a*. The voltage control unit 100 comprises the current control unit 46 of FIG. 2*b*. The voltage control unit 100 comprises a first connection terminal 102 and a second connection terminal 104 to connect the voltage control unit 100 to the output terminal 44 and to the neutral line 48. The voltage control unit 100 further comprises measurement means 106 to measure the output voltage V12 of the dimmer 10. The measurement means 106 is a sensitive voltmeter to identify a change in the output voltage V12 corresponding to the switching off of the switch 14 as shown in FIG. 1*b* at t1. The measurement means 106 provide a control signal 108 to the controllable switch 52 to switch the controllable switch 52 on. Hence, a significant change or step or edge can be provided in the output voltage V12 by means of the shunt current I10 provided by the current control unit 46.

Therefore the voltage control unit 100 can be provided as a separate module, which can be connected to an existing dimmer and an existing LED module.

Figure 5B:
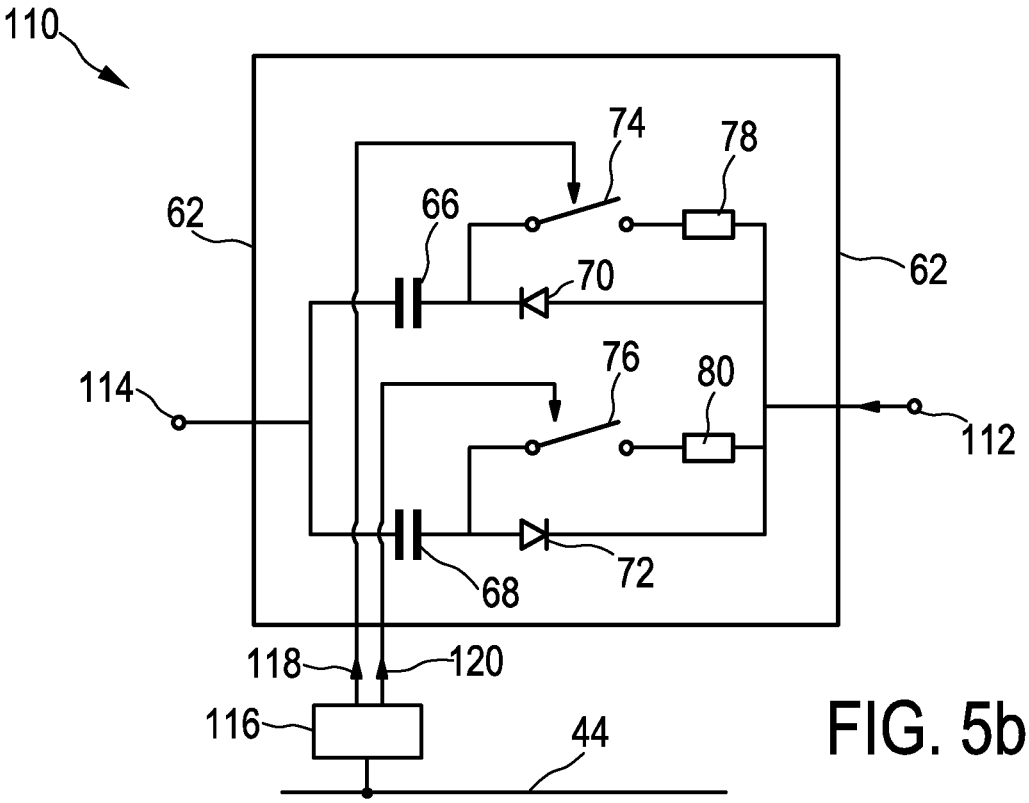
FIG. 5*b* shows a schematic block diagram of a voltage control unit according to a further embodiment of the present invention.

A second embodiment of a voltage control unit 110 is shown in FIG. 5*b*. The voltage control unit 110 comprises the current control unit 62 of FIG. 3*b*, a first connection terminal 112 for connecting the current control unit 62 to the output terminal 42 and a second connection terminal 114 for connecting the current control unit 62 to the input terminal 44. Further, the voltage control unit 110 comprises measurement means 116 connected to the output terminal 44 for measuring the output voltage V12 and for detecting a change in the output voltage corresponding to the switching off of the switch 14 indicating the cut-off of the supply voltage V12. The measurement means 116 provide two control signals 118, 120 to the controllable switches 74, 76 in line with the control signals 82, 84 shown in FIG. 3*b*. Hence, the voltage control unit 110 can be connected in parallel to an existing dimmer 10 as an add-on module and provides a significant and easy to detect step or edge when the phase cut dimmer 10 cuts the input voltage V10 corresponding to t1, t1' of FIG. 4.

Hence, the voltage control units 100, 110 can apply a signal to the output terminal when the phase of the input voltage is cut off.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A power control unit, said power control unit comprising:

a dimming unit for dimming a voltage of an external power supply and for controlling electrical power provided to a load, in particular an LED unit comprising one or more LEDs, having an input terminal for receiving an input voltage from the external power supply and having an output terminal for providing an output voltage to power the load, wherein the dimming unit comprises a switching device for transforming the input voltage to the output voltage, a control unit for controlling the switching device, a signal unit connected to the output terminal for applying a voltage or current signal to the output terminal, wherein the control unit is connected to the signal unit and adapted to control the signal unit, wherein the signal unit comprises a controllable switch which is connected to the output terminal, the control unit switches the controllable switch on at the same time as when the switching device of dimming unit is switched off.

2. The power control unit as claimed in claim 1, wherein the input voltage is an AC voltage provided by mains and the dimming unit is a phase cutting device, wherein the switching device is provided for cutting the phase of the AC voltage.

3. The power control unit as claimed in claim 1, wherein the signal unit comprise a current control unit for providing the signal by controlling a current drawn from the output terminal or provided to the output terminal.

4. The power control unit as claimed in claim 1, wherein the power control unit comprises detection means for detecting the output voltage.

5. The power control unit as claimed in claim 1, wherein the signal unit is adapted for controlling the course of the output voltage and for setting the slope of the output voltage to a predefined level.

6. The power control unit as claimed in claim 1, wherein the control unit is configured to activate the controllable switch when the output voltage is cut off by means of the switching device.

7. The power control unit as claimed in claim 1, wherein the control unit comprises a controllable current source.

8. The power control unit as claimed in claim 1, wherein the signal unit comprises a resistor connected in series with the controllable switch, wherein the controllable switch is activated in response to receiving a control signal from the dimming unit.

9. The power control unit as claimed in claim 1, wherein the controllable switch is connected to a neutral potential of the external power supply.

10. The power control unit as claimed in claim 1, wherein the signal unit is connected in parallel with the LED load.

11. The power control unit as claimed in claim 1, wherein the dimming unit is a phase cut dimmer configured to detect phase cut angle of the input voltage and to provide the output voltage.

12. A power unit for dimming a voltage of an external power supply and for controlling electrical power provided to a load, in particular an LED unit comprising one or more LEDs, said power control unit comprising:

a dimming unit having an input terminal for receiving an input voltage from an external power supply and having an output terminal for providing an output voltage to power the load, wherein the dimming unit comprises a switching device for transforming the input voltage to the output voltage, a control unit for controlling the switching device, a signal unit connected to the output terminal for applying a voltage or current signal to the output terminal, wherein the control unit is connected to the signal unit and adapted to control the signal unit, wherein the signal unit comprises a controllable switch connected to a charge capacitor which is connected to the input terminal, wherein a diode is connected in parallel to the controllable switch for charging the capacitor, and wherein the controllable switch is controlled by means of the control unit.

13. The power control unit as claimed in claim 12, wherein the signal unit comprises in parallel to the dimming unit two charge capacitors each connected in series with one diode, wherein the diodes are arranged in opposite forward-bias directions for charging the capacitors with different polarity, wherein one controllable switch is connected in parallel to each of the diodes and controlled by the control unit.

14. A voltage controller for controlling an output voltage of a converter unit for dimming a voltage of an external power supply and for controlling electrical power provided to a load, in particular an LED unit comprising one or more LEDs, the voltage controller comprising:

a first connection terminal for connecting the voltage controller to an output of the driver device, a second connection terminal for connecting the voltage controller to neutral or an input terminal of the converter unit, a signal unit for applying a voltage or current signal to the first connection terminal, detection means for detecting a phase cut-off of the output voltage, wherein the detection means are adapted to control the signal unit dependent on the detected phase cut-off, wherein the signal unit comprise two charge capacitors each connected in series with one diode, wherein the diodes are arranged in opposite forward-bias directions for charging the capacitors with different polarity and wherein the diodes are each connected in parallel to one controllable switch controlled by the detection means.

* * * * *